US006804369B2

(12) United States Patent
Masuda et al.

(10) Patent No.: US 6,804,369 B2
(45) Date of Patent: Oct. 12, 2004

(54) ELECTROACOUSTIC TRANSDUCER

(75) Inventors: Mitsuhiro Masuda, Shizuoka (JP); Takahiro Sone, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 533 days.

(21) Appl. No.: 09/849,987

(22) Filed: May 8, 2001

(65) Prior Publication Data

US 2001/0043706 A1 Nov. 22, 2001

(30) Foreign Application Priority Data

May 17, 2000 (JP) ..... P.2000-145250

(51) Int. Cl.[7] ..... H04R 25/00

(52) U.S. Cl. ..... 381/417; 381/412; 381/414; 381/421

(58) Field of Search ..... 381/396, 398, 381/409, 410, 417, 412, 420, 414, 421, 422, 431

(56) References Cited

U.S. PATENT DOCUMENTS 5,953,437 A 9/1999 Imahori et al.

5,974,157 A 10/1999 Tajima et al.

FOREIGN PATENT DOCUMENTS

| | | |
|---|---|---|
| EP | 0 999 722 A2 | 5/2000 |
| JP | 55-28040 | 2/1980 |

*Primary Examiner*—Huyen Le
(74) *Attorney, Agent, or Firm*—Sughrue Mion, PLLC

(57) ABSTRACT

An electroacoustic transducer 1 includes a base 24 made of a magnetic material; a magnetic core 22 made of a magnetic material and upstanding on the base 24; a diaphragm 20 made of a magnetic material and spaced from a leading end of the magnetic core; a magnetic field generating member 25 cooperating with the base 24, the magnetic core 22 and the diaphragm 20 to constitute a magnetic circuit, for supplying a static magnetic field; a coil 23 placed around the magnetic core, for supplying an oscillating magnetic field to the magnetic circuit. The magnetic field generating member 25 constitutes a multiplex ring structure in which a magnet 25a and a support ring 26 are integrated together, whose faces opposing the diaphragm 20 have respectively magnetic poles of the same polarity.

9 Claims, 9 Drawing Sheets

ELECTROACOUSTIC TRANSDUCER

BACKGROUND OF THE INVENTION

1. Field of the Invention

The present invention relates to an electroacoustic transducer that generates a sound by means of electromagnetic acoustic conversion.

2. Description of the Related Art

FIG. 10 is a perspective view showing an example of an electroacoustic transducer of the conventional art. The electroacoustic transducer 90 is configured by: a diaphragm 93 which is made of a magnetic material, and in which a magnetic piece 94 is fixed to the center; an electromagnetic coil (not shown) which supplies an oscillating magnetic field to the diaphragm 93; a housing member 91 which accommodates the diaphragm 93 and the electromagnetic coil; etc. Since a sound release opening 91*b* the diameter of which is larger than the magnetic piece 94 is formed in a top plate 91*a* which is opposed to the diaphragm 93, such a transducer is usually called an open-type electroacoustic transducer.

When an electric oscillating signal is supplied to the electromagnetic coil, the diaphragm 93 is oscillated by an oscillating magnetic field generated by the electromagnetic coil, to generate a sound. The sound is released to the outside through the sound release opening 91*b*.

A support ring which supports a peripheral portion of the diaphragm 93, and a ring-like magnet which supplies a static magnetic field are accommodated in the electroacoustic transducer 90. When the dimensions of the magnet are designed so as to be as large as possible in order to enhance the magnetic field generated by the magnet, the magnet is structured to be in close contact with the inner side of the support ring.

On the other hand, when the back space of the diaphragm is small in volume, the resonance frequency f0 of the diaphragm is raised by the air damping effect. Therefore, the air damping effect exerts a larger effect as the transducer is smaller in size.

Under those circumstances, when a magnet material having a high maximum energy product (BHmax) is selected as the magnet material so as to reduce the size of the magnet, a space can be ensured between the magnet and the support ring. Therefore, the volume of the back space can be increased. In this case, the magnet is separated from the support ring, and hence a fixation method using an adhesive agent may be employed. However, such a fixation method has fears such as that the adhesive agent deteriorates with age, and that the production cost is increased by conducting a bonding step.

SUMMARY OF THE INVENTION

The present invention has been made to solve the above problems, and therefore an object of the invention is to provide an electroacoustic transducer in which a magnet can be surely fixed while ensuring a large back space of a diaphragm, and which can be miniaturized and produce a high sound pressure.

According to a first aspect of the invention, there is provided an electroacoustic transducer comprising: a base member made of a magnetic material; a magnetic core made of a magnetic material and upstanding on said base member; a diaphragm made of a magnetic material and spaced from a leading end of said magnetic core; a magnetic field generating member which cooperates with said base member, said magnetic core and said diaphragm to constitute a magnetic circuit, for supplying a static magnetic field; and a coil placed around said magnetic core for supplying an oscillating magnetic field to said magnetic circuit; wherein said magnetic field generating member comprises multiple ring members whose faces opposing said diaphragm have respectively magnetic poles of the same polarity, respectively.

In the first aspect of the invention, the magnetic field generating member comprises multiple ring members whose faces opposing the diaphragm have respectively magnetic poles of the same polarity, respectively. Therefore, a magnetic field loop which starts from the diaphragm opposing faces of the ring members toward the center of the diaphragm and then returns to the bottom faces of the ring members through the magnetic core and the base member can be multiplexed. As compared with the case of a single magnetic field loop, consequently, the magnetic attractive force for the diaphragm can be remarkably improved. As a result, the pressure level of a sound generated by the diaphragm can be raised, and the frequency characteristics of a sound can be flattened.

According to a second aspect of the invention, an outermost one of the ring members supports a peripheral portion of the diaphragm.

Therefore, when a peripheral portion of the diaphragm is supported by the outermost ring member, the ring members can function as both of a magnet and a support ring. Therefore, the space reduction is attained, so that the transducer can be miniaturized.

According to a third aspect of the invention, the ring members are integrated together with coupling members which are intermittently arranged in a circumferential direction.

Therefore, when the ring members are coupled with one another by coupling members which are intermittently arranged, spaces can be formed between the coupling members, and hence the back space of the diaphragm can be increased. As a result, even when the transducer is miniaturized, influences due to the air damping effect can be reduced.

Since the ring members are integrated together, the production cost can be lowered by reduction of the numbers of components and fixing positions, and the positioning accuracy of the components can be improved.

According to a fourth aspect of the invention, communication grooves through which an inner side and an outer side communicate with each other are formed in a bottom face of an outermost one of the ring members.

Therefore, when the communication grooves are formed in the bottom face of the outermost ring member, routes through which the back space of the diaphragm communicates with the external space can be ensured. As a result, the hermeticity of the back space is lowered, thereby being capable of further reducing an influence of the air damping effect.

According to a fifth aspect of the invention, there is further provided a magnetic piece fixed to the diaphragm and having a diameter which is equal to or larger than an inner diameter of an innermost one of the ring members.

Therefore, since the diameter of the magnetic piece is equal to or larger than the inner diameter of the innermost ring member, lines of magnetic force passing through the magnetic piece are increased in number, and hence the magnetic attractive force for the diaphragm can be enhanced.

According to a sixth aspect of the invention, there is provided an electroacoustic transducer comprising: a base member made of a magnetic material; a magnetic core made of a magnetic material and upstanding on said base member; a diaphragm made of a magnetic material and spaced from a leading end of said magnetic core; a magnetic field generating member which cooperates with said base member, said magnetic core and said diaphragm to constitute a magnetic circuit, for supplying a static magnetic field; and a coil placed around said magnetic core, for supplying an oscillating magnetic field to said magnetic circuit; wherein said magnetic field generating member comprises a ring member and a plurality of rib members that protrude inward.

According to the invention, the magnetic field generating member is configured by the ring member, and the plurality of rib members which inward protrude. Therefore, spaces can be formed between the rib members while ensuring the volume of the magnet, and hence the back space of the diaphragm can be increased. As a result, even when the transducer is miniaturized, influences due to the air damping effect can be reduced.

According to a seventh aspect of the invention, the ring member supports a peripheral portion of the diaphragm.

Therefore, when a peripheral portion of the diaphragm is supported by the ring member, the ring member can function as both of a magnet and a support ring. Therefore, the space reduction is attained, thereby being capable of miniaturizing the transducer.

According to an eighth aspect of the invention, communication grooves through which an inner side and an outer side communicate with each other are formed in a bottom face of the ring member.

Therefore, when the communication grooves are formed in the bottom space of the ring member, routes through which the back face of the diaphragm communicates with the external space can be ensured. Therefore, the hermeticity of the back space is lowered, thereby being capable of further reducing an influence of the air damping effect.

According to an eighth aspect of the invention, there is further provided a magnetic piece fixed to the diaphragm and having a diameter which is equal to or larger than an innermost diameter of the rib members.

Therefore, since the diameter of the magnetic piece is equal to or larger than the inner diameter of the innermost rib member, lines of magnetic force passing through the magnetic piece are increased in number, and hence the magnetic attractive force for the diaphragm can be enhanced.

DETAILED DESCRIPTION OF THE PREFERRED EMBODIMENTS

Now, a description will be given in more detail of preferred embodiments of the invention with reference to the accompanying drawings.

Figure 1:
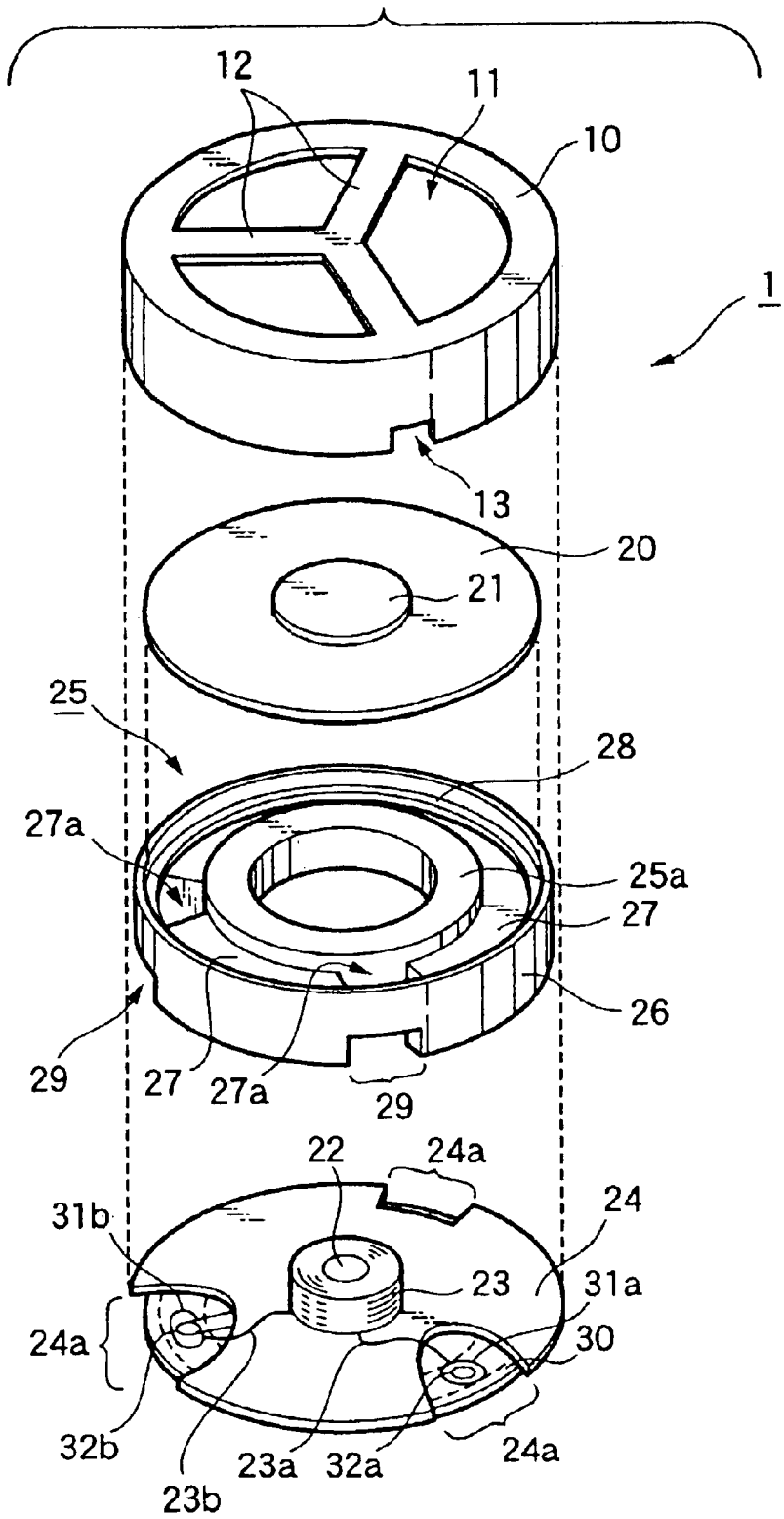
FIG. 1 is an exploded perspective view showing an embodiment of the invention.
Figure 2A:
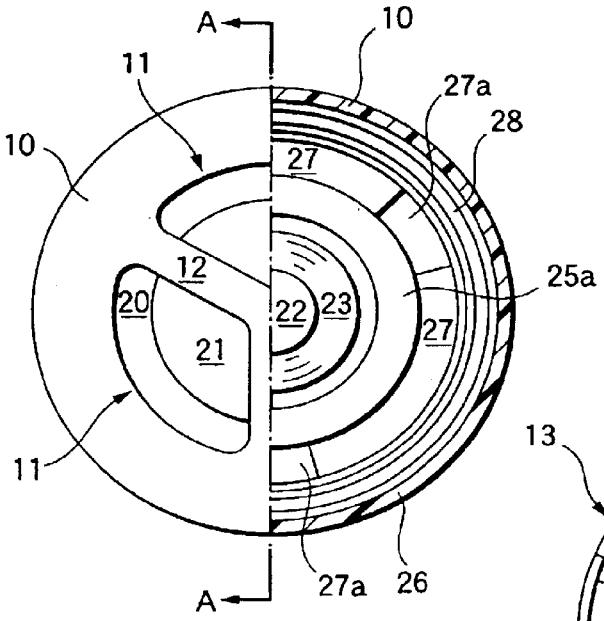
FIG. 2A is a front view (left half) and a section view (right half) as seeing from a sound release hole 11.
Figure 2B:
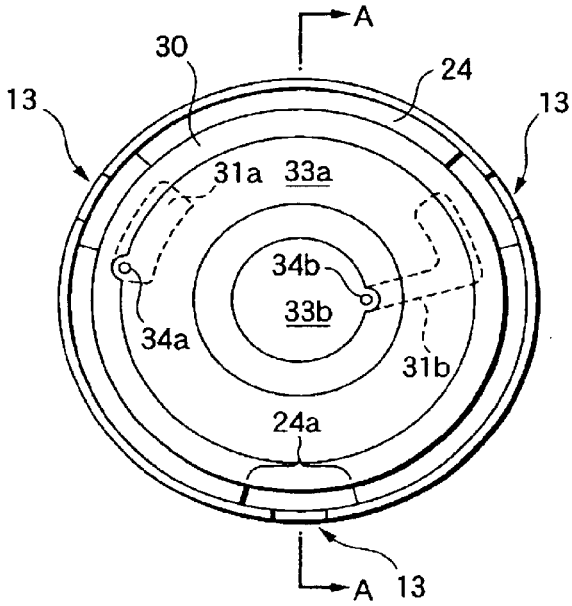
FIG. 2B is a bottom view.
Figure 2C:
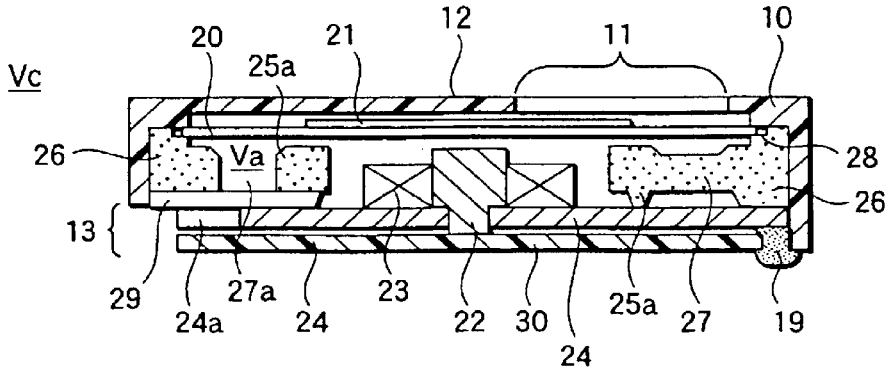
FIG. 2C is an end view taken along the line A—A of FIG. 2A.

FIG. 1 is an exploded perspective view showing an embodiment of the invention, FIG. 2A is a front view (left half) and a section view (right half) as seeing from a sound release hole 11, FIG. 2B is a bottom view, and FIG. 2C is an end view taken along the line A—A of FIG. 2A.

An electroacoustic transducer 1 is configured by accommodating a base 24, a magnetic core 22, a coil 23, a magnetic field generating member 25, and a diaphragm 20 in a housing 10, and has a flat columnar shape as a whole. For example, the whole of the transducer has approximate dimensions of 12 mm in diameter×3 mm in height.

The base 24 has a disk-like shape in which cutaway portions 24*a* are formed in the circumference. In the embodiment, three cutaway portions 24*a* are formed in the circumference at intervals of 120 deg., and two of the cutaway portions 24*a* are formed into a U-like shape. A columnar magnetic core 22 upstands on the center of base 24. A coil 23 is placed around the magnetic core 22. The base 24 and the magnetic core 22 are made of a magnetic material, and may be integrated with each other by caulking or the like so as to be configured as a single pole-piece member.

A disk-like printed circuit board 30 which is slightly smaller than the outer diameter of the base 24 is attached to the bottom face of the base 24. Connecting lands 31*a* and 31*b* which are to be electrically connected to lead wires 23*a* and 23*b* of the coil 23 by soldering or the like are formed on the upper face of the printed circuit board 30. The connecting lands 31*a* and 31*b* are respectively placed in the U-like cutaway portions 24*a* so that the spaces for connection processing portions 32*a* and 32*b* are ensured by the thickness of the base 24.

This placement of the connection processing portions 32*a* and 32*b* on the side of the inner space enables the work of connecting the lead wires 23*a* and 23*b* to be easily performed, and the transducer to be thinned so that the height in mounting can be reduced. Since the connection processing portions 32*a* and 32*b* are not exposed to the outside, the reliability of the connection processing portions can be improved.

As shown in FIG. 2B, connecting lands 33*a* and 33*b* for obtaining electrical connection with an external circuit board are concentrically formed on the bottom face of the printed circuit board 30. Through holes 34*a* and 34*b* are formed in parts of the connecting lands 33*a* and 33*b* so as to attain connections between the connecting lands 31*a* and 31*b* on the upper face, and the connecting lands 33*a* and 33*b* on the bottom face.

Returning to FIG. 1, the magnetic field generating member 25 has a multiplex ring structure in which a ring-like magnet 25*a* and a support ring 26 are concentrically placed, and is placed on the base 24 so as to be concentric therewith. An example of a method of producing the magnetic field generating member 25 is a method in which particles of a permanent magnet material such as ferrite are dispersed in a plastic material, which is injection-molded into a desired shape. When a magnetic field is applied in the thickness direction of the magnetic field generating member 25, N- and S-poles, or S- and N-poles can be generated in the upper and bottom faces of the magnet 25*a* and the support ring 26, respectively.

The magnetic field generating member 25 has a multiplex ring structure in which the faces opposing the diaphragm 20 respectively have magnetic poles of the same polarity. Therefore, a multiplex magnetic loop can be formed in which lines of magnetic force that are directed from the upper faces the magnet 25*a* and the support ring 26 to the center of the diaphragm 20 are generated, and that pass through the magnetic core 22 and the base 24 and then return to the bottom faces of the magnet 25*a* and the support ring 26. As a result, the magnetic attractive force for the diaphragm 20 can be remarkably improved as compared with the case of a single magnetic field loop.

The magnet 25*a* and the support ring 26 are formed integrally with one another together with coupling ribs 27 which are intermittently arranged in a circumferential direction. For example, three coupling ribs 27 are arranged at intervals of 120 deg., and three spaces 27*a* which vertically elongate are formed respectively between adjacent pairs of the coupling ribs 27. The spaces 27*a* are opened in the back space of the diaphragm 20. Therefore, the back space of the diaphragm is increased, so that influences due to the air damping effect can be reduced.

The outer diameter of the support ring 26 is substantially equal to that of the base 24. As shown in FIG. 2A, a plurality of annular steps are formed on the inside of the support ring 26. Among the steps, the upper one is formed as a diaphragm supporting step 28. The disk-like diaphragm 20 is placed on the supporting step 28, and positioned in place.

Communication grooves 29 through which the inner space and the outer space communicate with each other are formed in the bottom face of the support ring 26. Three communication grooves 29 are formed at intervals of 120 deg. so as to respectively correspond to the positions of the cutaway portions 24*a* of the base 24.

The diaphragm 20 is made of a magnetic material, and supported at the peripheral edge portion by the supporting step 28 of the support ring 26, and a constant air gap is ensured between the center of the back face of the diaphragm 20 and the forward end of the magnetic core 22. A disk-like magnetic piece 21 is fixed to the center of the front face of the diaphragm 20 so as to increase the mass of the diaphragm 20, thereby improving the efficiency of oscillating the air.

Preferably, the diameter of the magnetic piece 21 is equivalent to or larger than the inner diameter of the magnet 25*a*. According to this configuration, lines of magnetic force passing through the magnetic piece 21 are increased in number, and hence the magnetic attractive force for the diaphragm 20 can be enhanced.

The housing 10 is made of synthetic resin such as thermoplastic resin, and formed into a cylindrical box-like shape so as to coincide with the outer diameter of the base 24. As shown in FIG. 2C, the housing 10, the base 24, and the printed circuit board 30 are bonded together by a bonding material 19 such as an adhesive agent or a molding resin.

In the top plate of the housing 10, the sound release hole 11 the diameter of which is larger than the magnetic piece 21 is formed so as to be opposed to the diaphragm 20, thereby constituting an open-type electroacoustic transducer. For example, the magnetic piece 21 has a diameter of 6 mm, and the sound release hole 11 has a diameter of about 8 mm. In the sound release hole 11, beams 12 through which the peripheral edge is bridge-coupled is formed so as to pass over the magnetic piece 21. The beams 12 are integrated with the housing 10. In the embodiment, an example in which three beams are arranged at intervals of 120 deg. is shown. Alternatively, two beams which are arranged at intervals of 180 deg., four beams which are arranged at intervals of 90 deg., or five or more beams may be used.

When the beams 12 are formed as described above, it is possible to protect the diaphragm 20 from external objects and to reinforce the housing 10. As shown in FIG. 2C, the beams 12 are formed in positions where the beams allow the diaphragm 20 to normally oscillate and do not cause the whole height of the transducer to be increased.

Preferably, a ratio Se/So 70% or more where Se is the effective opening area in the case where the beams are formed and So is the opening area in the case where the beams are not formed. At this ratio, the influence which is exerted on the acoustic performance by the beams is negligibly small.

Three cutaway portions 13 are formed at intervals of 120 deg. in a bottom portion of the side face of the housing 10. The positions of the cutaway portions 13 correspond to those of the communication grooves 29 of the support ring 26, and also to those of the cutaway portions 24*a* of the base 24 as shown in FIG. 2B.

When the communication grooves 29, the cutaway portions 24*a*, and the cutaway portions 13 are disposed and the coupling ribs 27 are intermittently arranged as described above, paths through which the back space Vb of the diaphragm 20 and the external space Vc communicate with each other can be formed. In the embodiment, an example in which three external-communication paths are arranged at intervals of 120 deg. is shown. Alternatively, a configuration in which two communication paths are arranged at intervals of 180 deg., that in which four communication paths are arranged at intervals of 90 deg., or other configurations in which five or more external-communication paths are arranged, or external-communication paths are asymmetrically arranged may be used.

Next, the operation will be described. The magnetic field generating member 25 is magnetized in the thickness direction. When the upper faces of the magnet 25*a* and the support ring 26 are magnetized to the N-pole and the bottom faces to the S-pole, for example, lines of magnetic force emerging from the upper face of the magnet 25*a* pass through a first route of the diaphragm 20, the magnetic piece 21, the magnetic core 22, the base 24 and the bottom face of the magnet 25 in the stated order. Lines of magnetic force emerging from the upper face of the support ring 26 pass through a second route of the diaphragm 20, the magnetic piece 21, the magnetic core 22, the base 24 and the bottom face of the support ring 26 in the stated order. The two magnetic loops are superimposed on each other in the vicinity of the magnetic piece 21 to constitute a double magnetic circuit which is closed as a whole.

The magnetic field generating member 25 has a function of supplying a static magnetic field to the magnetic circuit.

The diaphragm 20 is stably supported in a state where the diaphragm is attracted toward the magnetic core 22, the magnet 25*a*, and the support ring 26 by the static magnetic field.

When an electric oscillating signal is supplied from the circuit board to the coil 23 wound around the magnetic core 22 via the connecting lands 33*a* and 33*b*, the through holes 34*a* and 34*b*, the connecting lands 31*a* and 31*b*, and the lead wires 23*a* and 23*b*, the coil supplies an oscillating magnetic field to the magnetic circuit. Then, the oscillating magnetic field is superimposed on the static magnetic field, whereby the diaphragm 20 is oscillated. As a result, the air on the side of the front face of the diaphragm 20, and that on the side of the back face are oscillated.

The sound which is generated on the side of the front face of the diaphragm 20 is emitted to the outside through the sound release hole 11. The sound which is generated on the side of the back face of the diaphragm 20 is opposite in phase to the sound on the side of the front face, and hence interference with the sound on the side of the front face must be suppressed as far as possible. To comply with this, the sound on the side of the back face of the diaphragm 20 is emitted to the outside via the annular inner space, the spaces 27*a*, the communication grooves 29, the cutaway portions 24*a*, and the cutaway portions 13 of the housing 10.

When the communication paths for a back sound are disposed in this way, the air damping effect in the back space of the diaphragm 20 can be efficiently lowered, so that it is possible to realize an electromagnetic acoustic transducer which is small in size and produces a high sound pressure.

The formation of the cutaway portions 13 in the side wall of the housing 10 prevents the back face paths from being closed even in a state where the bottom face of the transducer is closely mounted on a circuit board. Therefore, the mounting height can be reduced.

Figure 3A:
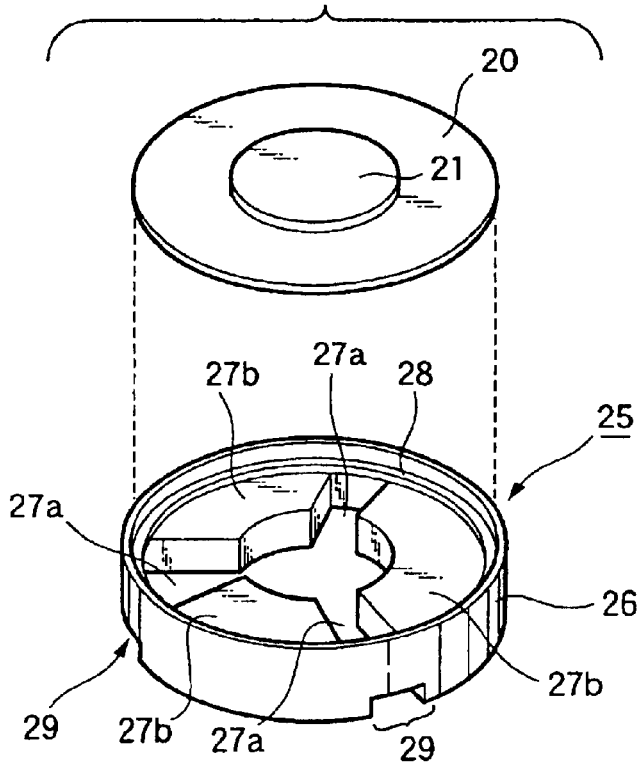
FIG. 3A is an exploded perspective view showing another embodiment of the invention.
Figure 3B:
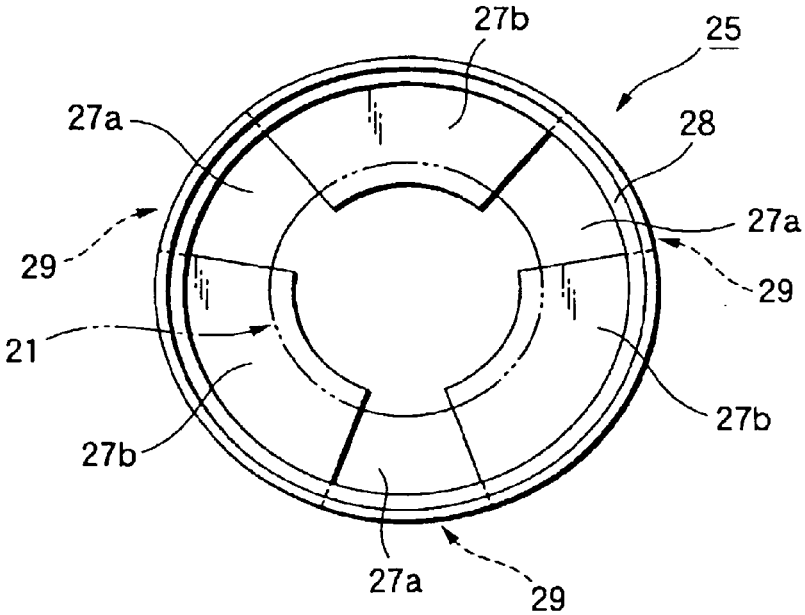
FIG. 3B is a front view as seeing from the upper side.

FIG. 3A is an exploded perspective view showing another embodiment of the invention, and FIG. 3B is a front view as seeing from the upper side. In the embodiment, the shape of the magnetic field generating member 25 is different from that shown in FIG. 1, and the other components are identical with those shown in FIG. 1. Therefore, illustration of such components is partly omitted.

In the magnetic field generating member 25, the support ring 26, and a plurality of protruding ribs 27*b* which protrude into the inner side of the support ring 26 are integrally formed, and placed on the base 24 so as to be concentrical with the magnetic core 22 in the same manner as FIG. 1. An example of a method of producing the magnetic field generating member 25 is a method in which particles of a permanent magnet material such as ferrite are dispersed in a plastic material, which is injection-molded into a desired shape. When a magnetic field is applied in the thickness direction of the magnetic field generating member 25, N- and S-poles, or S- and N-poles can be formed in the upper and bottom faces of the support ring 26 and the protruding ribs 27*b*, respectively.

As shown in FIG. 3B, preferably, the diameter of the magnetic piece 21 is equivalent to or larger than the innermost diameter of the protruding ribs 27*b*. According to this configuration, lines of magnetic force passing through the magnetic piece 21 are increased in number, and hence the magnetic attractive force for the diaphragm 20 can be enhanced.

The protruding ribs 27*b* are intermittently arranged in a circumferential direction. For example, three protruding ribs 27*b* are arranged at intervals of 120 deg., and three spaces 27*a* which vertically elongate are formed respectively between adjacent pairs of the protruding ribs 27*b*. The spaces 27*a* are opened in the back space of the diaphragm 20. Therefore, the back space of the diaphragm is increased, so that influences due to the air damping effect can be reduced.

The outer diameter of the support ring 26 is substantially equal to that of the base 24. A plurality of annular steps are formed on the inside of the support ring 26. Among the steps, the upper one is formed as a diaphragm supporting step 28. In the same manner as FIG. 1, the disk-like diaphragm 20 is placed on the supporting step 28, and positioned in place.

Communication grooves 29 through which the inner space and the outer space communicate with each other are formed in the bottom face of the support ring 26. Three communication grooves 29 are formed at intervals of 120 deg. so as to respectively correspond to the positions of the cutaway portions 24*a* of the base 24.

Figure 4:
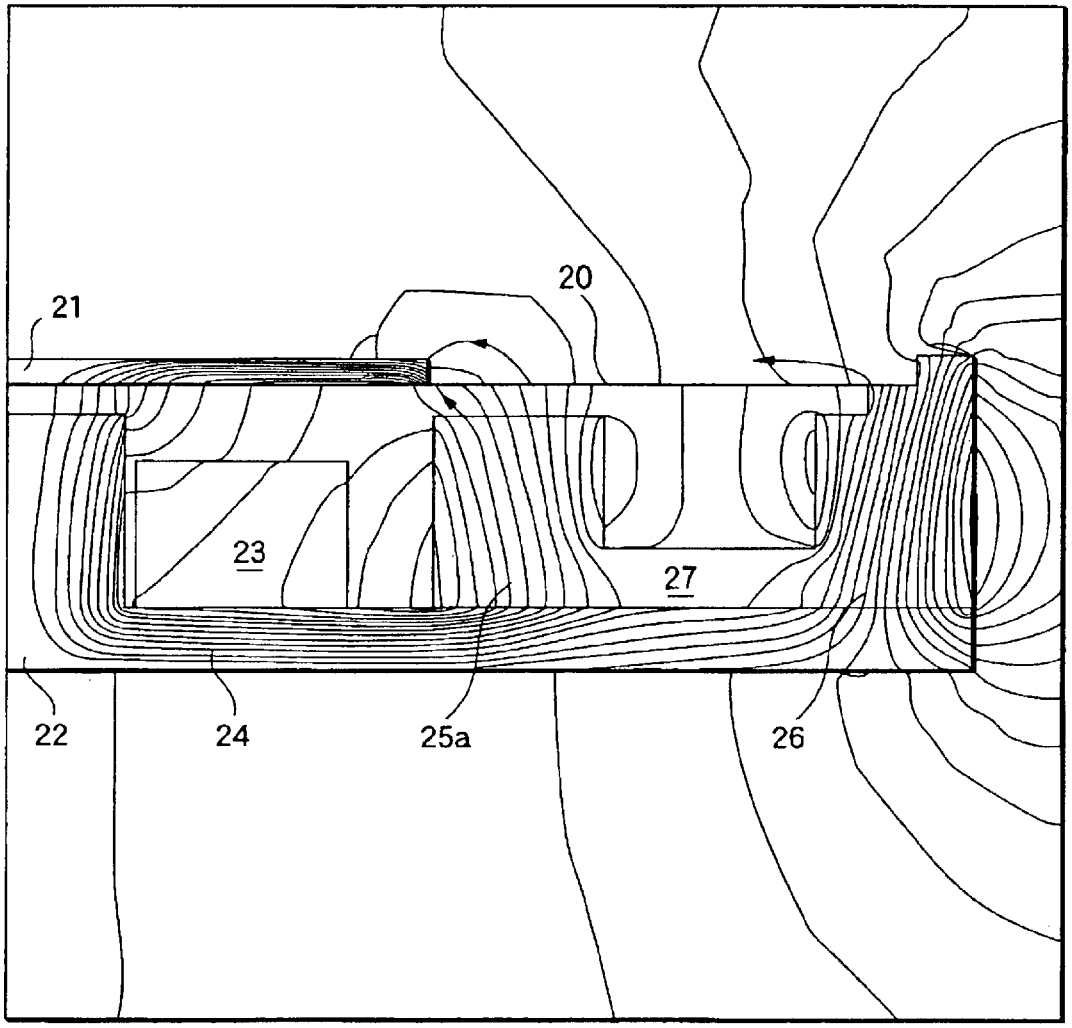
FIG. 4 is a graph showing the magnetic field distribution in the case where a magnetic field generating member of FIG. 1 is used.

FIG. 4 is a graph showing the magnetic field distribution in the case where the magnetic field generating member 25 of FIG. 1 is used. The graph is obtained by analyzing the magnetic field distribution in a section view elongating from the center of the magnetic core 22 along a radial direction, by using the finite element method. The magnetic field generating member 25 is made of a plastic magnet material in which ferrite particles are dispersed.

From the graph, it will be seen that there are an inner magnetic loop of the upper face of the magnet 25*a* the diaphragm 20 and the magnetic piece 21→ the magnetic core 22→ the base 24→ the bottom face of the magnet 25, and an outer magnetic loop of the upper face of the support ring 26→ the diaphragm 20 and the magnetic piece 21→ the magnetic core 22→ the base 24→ the bottom face of the support ring 26. At this time, the magnetic attractive force for the diaphragm 20 is 0.59 N.

Figure 5:
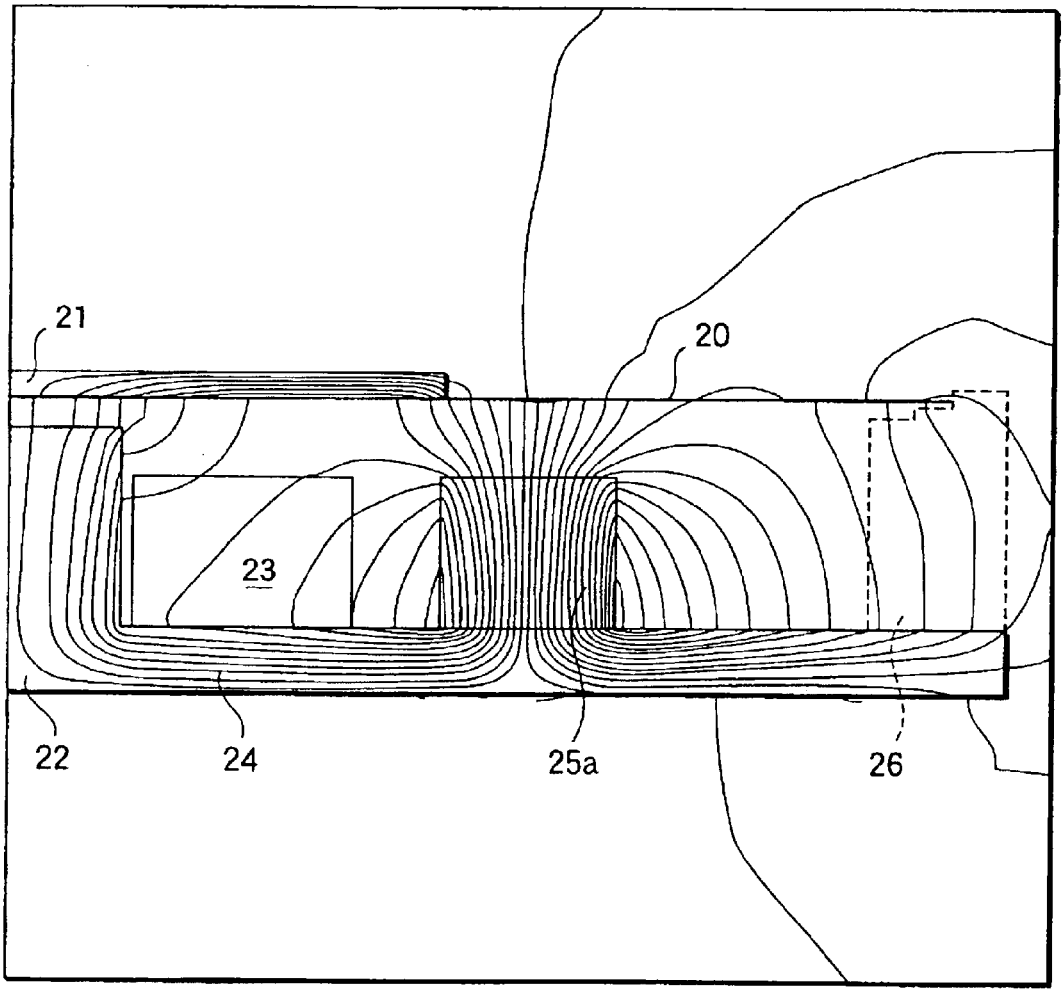
FIG. 5 is a graph showing the magnetic field distribution in comparative example 1.

FIG. 5 is a graph showing the magnetic field distribution in comparative example 1. In the comparative example 1, the support ring 26 is made of a non-magnetic material, and the material of the magnet 25*a* is identical with that of FIG. 4.

As seen from the graph, substantially inner half of lines of magnetic force emerging from the upper face of the magnet 25*a* are directed to the magnetic core 22 and pass through the diaphragm 20 and the magnetic piece 21, and the remaining half of lines of magnetic force are directed outward. Therefore, it is expected that the magnetic utilization factor is lowered, and the magnetic attractive force for the diaphragm 20 is 0.19 N.

Figure 6:
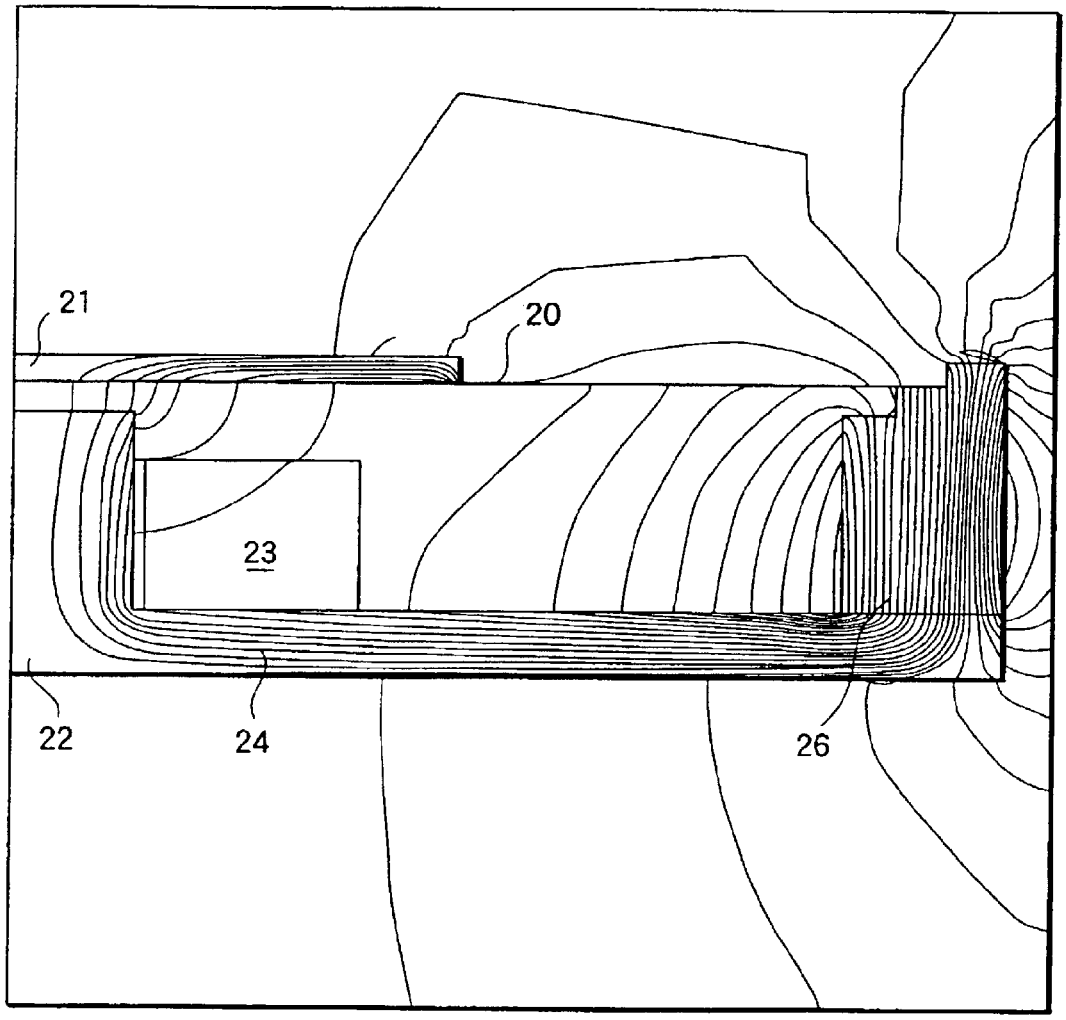
FIG. 6 is a graph showing the magnetic field distribution in comparative example 2.

FIG. 6 is a graph showing the magnetic field distribution in comparative example 2. In the comparative example 2, the magnet 25*a* is not used, the support ring 26 is used also as a magnet, and the material of the support ring is identical with that of FIG. 4.

As seen from the graph, substantially inner half of lines of magnetic force emerging from the upper face of the support ring 26 are directed to the magnetic core 22 and pass through the diaphragm 20 and the magnetic piece 21, and the remaining half of lines of magnetic force are directed outward. Therefore, it is expected that the magnetic utilization factor is lowered, and the magnetic attractive force for the diaphragm 20 is 0.24 N.

Figure 7:
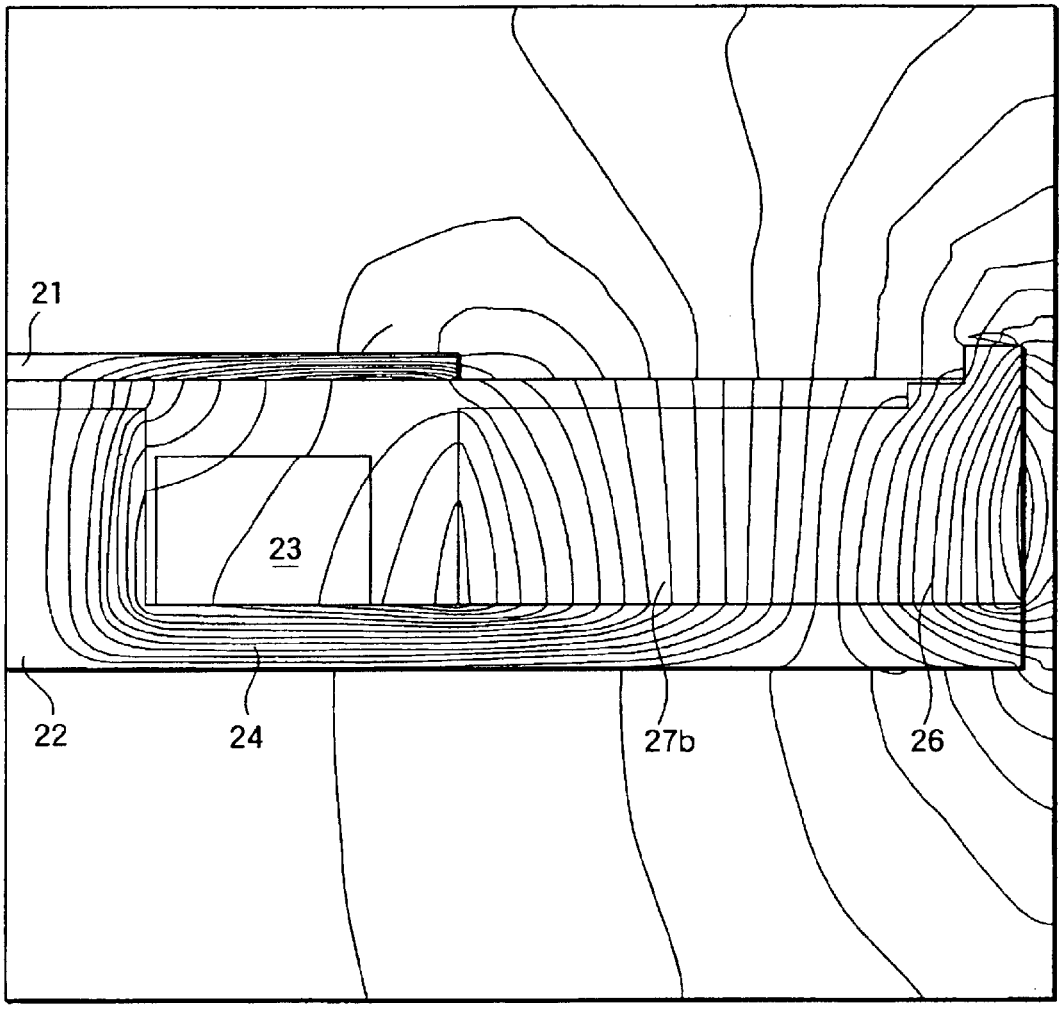
FIG. 7 is a graph showing the magnetic field distribution in the case where a magnetic field generating member of FIGS. 3A and 3B is used.

FIG. 7 is a graph showing the magnetic field distribution in the case where the magnetic field generating member 25 of FIGS. 3A and 3B is used. The graph is shown in the form of a section view elongating from the center of the magnetic core 22 and passing through one of the protruding ribs 27*b*. The material of the magnetic field generating member 25 is identical with that of FIG. 4.

As seen from the graph, lines of magnetic force which are substantially uniformly distributed are generated from the upper faces of the support ring 26 and the protruding rib 27*b* and then pass through the diaphragm 20 and the magnetic piece 21. The protruding rib 27*b* corresponds to the shape in which the groove on the coupling rib 27 in FIG. 4 is filled. Therefore, it is expected that the magnetic utilization factor is approximately equal to that of FIG. 4, and the magnetic attractive force for the diaphragm 20 is 0.60 N.

As described above, in the transducers of FIGS. 4 and 7, the number of lines of magnetic force passing through the diaphragm 20 and the magnetic piece 21 is larger than that in the transducers of FIGS. 5 and 6, and hence it will be seen that the magnetic attractive force for the diaphragm 20 can be remarkably enhanced.

Figure 8:
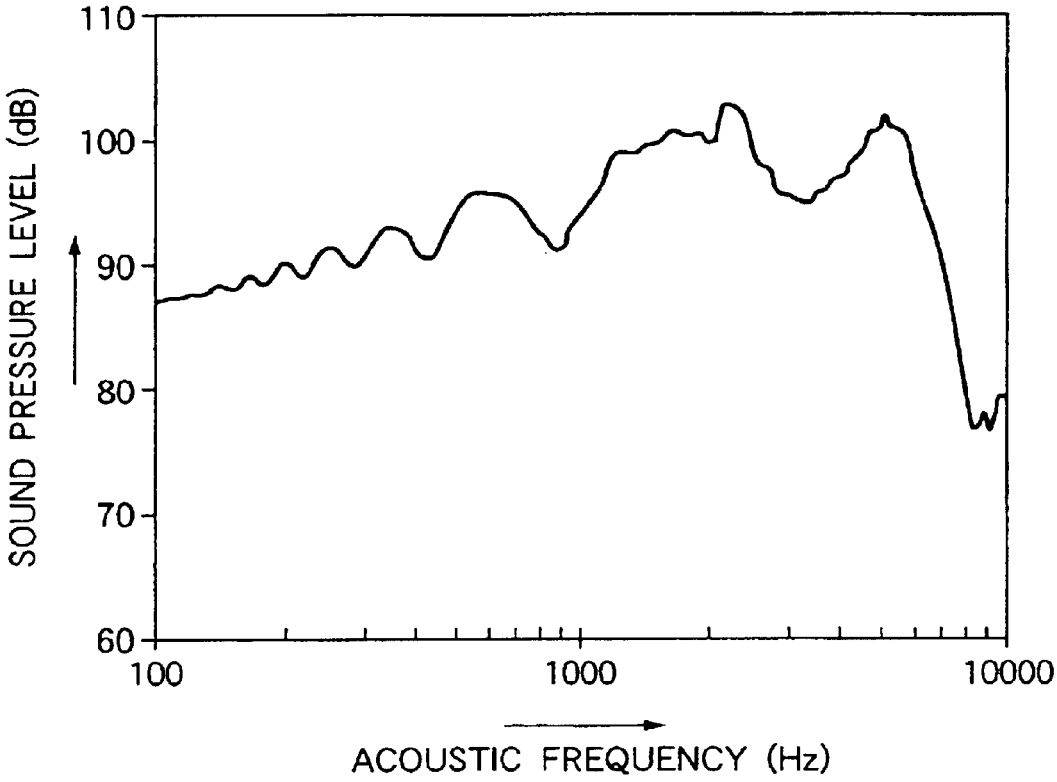
FIG. 8 is a graph exemplarily showing the frequency characteristics of an electroacoustic transducer shown in FIG. 4 according to the invention.
Figure 9:
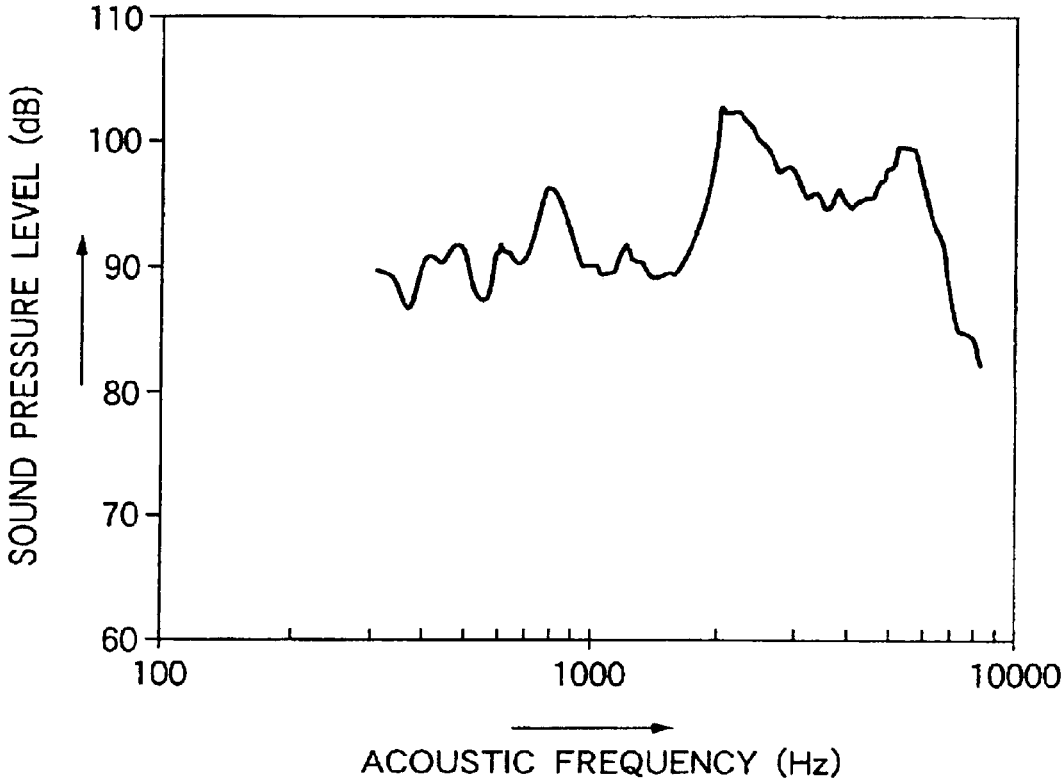
FIG. 9 is a graph exemplarily showing the frequency characteristics of a transducer in which the comparative example 1 of FIG. 5 is configured by forming a magnet by neodium.
Figure 10:
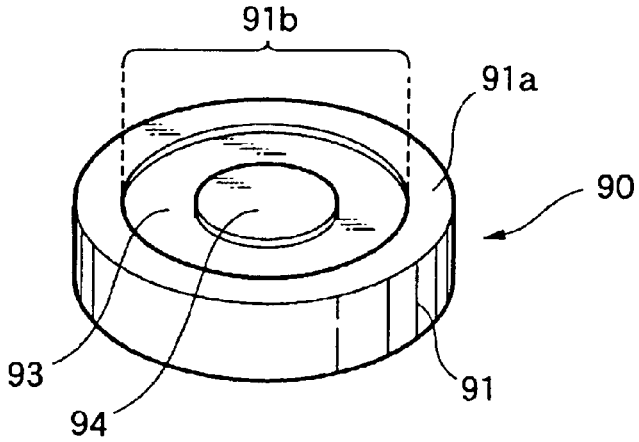
FIG.10 (PRIOR ART)
FIG. 10 is a perspective view showing an example of a conventional electroacoustic transducer.

FIG. 8 is a graph exemplarily showing the frequency characteristics of the electroacoustic transducer 1 shown in FIG. 4 according to the invention, and FIG. 9 is a graph exemplarily showing those of a transducer in which the comparative example 1 of FIG. 5 is configured by forming the magnet 25*a* by neodium. In the graphs, the abscissa indicates the acoustic frequency (Hz), and the ordinate indicates the sound pressure level (dB). The maximum energy product (BHmax) of neodium is five times that of a plastic magnet material in which ferrite particles are dispersed.

When the graphs are compared with each other, it will be seen that the frequency characteristics of the graph of FIG. 8 are flat as a whole, and that, particularly, the sound pressure level is raised by about 10 dB in the vicinity of 1 to 2 kHz which are in a usual driving frequency range.

From the above, it will be seen that, even when the magnet material has a small maximum energy product (BHmax), the sound pressure level can be improved by improving the shape, and more ideal frequency characteristics can be obtained.

As described above in detail, according to the invention, the magnetic loop can be multiplexed by configuring the magnetic field generating member by a multiple of ring members in which faces opposing the diaphragm have respectively magnetic poles of a same polarity. As compared with the case of a single magnetic field loop, therefore, the magnetic attractive force for the diaphragm can be remarkably improved, the sound pressure level can be raised, and the frequency characteristics can be flattened.

Furthermore, the back space of the diaphragm can be increased. Even when the transducer is miniaturized, therefore, influences due to the air damping effect can be reduced.

What is claimed is:

1. An electroacoustic transducer comprising:

a base member made of a magnetic material;

a magnetic core made of a magnetic material and upstanding on said base member;

a diaphragm made of a magnetic material and spaced from a leading end of said magnetic core;

a magnetic field generating member which cooperates with said base member, said magnetic core and said diaphragm to constitute a magnetic circuit, for supplying a static magnetic field; and a coil placed around said magnetic core for supplying an oscillating magnetic field to said magnetic circuit;

wherein said magnetic field generating member comprises multiple ring members formed by magnets that generate magnetic force and whose faces opposing said diaphragm have respectively magnetic poles of the same polarity, respectively.

2. The electroacoustic transducer according to claim 1, wherein an outermost one of said ring members supports a peripheral portion of said diaphragm.

3. The electroacoustic transducer according to claim 1, wherein said ring members are integrated together with coupling members which are intermittently arranged in a circumferential direction.

4. The electroacoustic transducer according to claim 1, wherein communication grooves through which an inner side and an outer side communicate with each other are formed in a bottom face of an outermost one of said ring members.

5. An electroacoustic transducer according to claim 1, further comprising:

a magnetic piece fixed to said diaphragm, said magnetic piece having a diameter which is equal to or larger than an inner diameter of an innermost one of said ring members.

6. An electroacoustic transducer comprising:

a base member made of a magnetic material;

a magnetic core made of a magnetic material and upstanding on said base member;

a diaphragm made of a magnetic material and spaced from a leading end of said magnetic core;

a magnetic field generating member which cooperates with said base member, said magnetic core and said diaphragm to constitute a magnetic circuit, for supplying a static magnetic field; and a coil placed around said magnetic core, for supplying an oscillating magnetic field to said magnetic circuit;

wherein said magnetic field generating member comprises a ring member formed by magnets that generate magnetic force and a plurality of rib members that protrude inward and are formed by magnets that generate magnetic force.

7. The electroacoustic transducer according to claim 6, wherein said ring member supports a peripheral portion of said diaphragm.

8. The electroacoustic transducer according to claim 6, wherein communication grooves through which an inner side and an outer side communicate with each other are formed in a bottom face of said ring member.

9. An electroacoustic transducer comprising:

a base member made of a magnetic material;

a magnetic core made of a magnetic material and upstanding on said base member;

a diaphragm made of a magnetic material and spaced from a leading end of said magnetic core;

a magnetic field generating member which cooperates with said base member, said magnetic core and said diaphragm to constitute a magnetic circuit, for supplying a static magnetic field:

a coil placed around said magnetic core, for supplying an oscillating magnetic field to said magnetic circuit, wherein said magnetic field generating member comprises a ring member and a plurality of rib members that protrude inward: and a magnetic piece fixed to said diaphragm, said magnetic piece having a diameter which is equal to or larger than an innermost diameter of said rib members.

* * * * *